US007690142B2

(12) United States Patent
Pollack

(10) Patent No.: US 7,690,142 B2
(45) Date of Patent: Apr. 6, 2010

(54) NOTE HOLDER

(76) Inventor: Ronald M. Pollack, 69-37 Harrow St., Forest Hills, NY (US) 11375-5151

( * ) Notice: Subject to any disclaimer, the term of this patent is extended or adjusted under 35 U.S.C. 154(b) by 0 days.

(21) Appl. No.: 12/080,411

(22) Filed: Apr. 2, 2008

(65) Prior Publication Data

US 2008/0209786 A1 Sep. 4, 2008

Related U.S. Application Data

(63) Continuation-in-part of application No. PCT/US2006/045262, filed on Nov. 22, 2006, which is a continuation of application No. 11/285,971, filed on Nov. 23, 2005, now abandoned.

(51) Int. Cl.
*G09F 3/20* (2006.01)

(52) U.S. Cl. ..... 40/658; 248/442.2; 24/67.11; 24/546; 24/563

(58) Field of Classification Search ..... 40/658; 248/442.2, 441.1, 465.1; 24/67.1, 546, 563, 24/67.9, 545, 555

See application file for complete search history.

(56) References Cited

U.S. PATENT DOCUMENTS

| | | | | |
|---|---|---|---|---|
| 2,329,974 | A * | 9/1943 | Bennett | 24/67.11 |
| 2,493,503 | A * | 1/1950 | Renne | 24/555 |
| 2,530,821 | A | 11/1950 | Hubbell | |
| 2,785,919 | A | 3/1957 | Grondzik | |
| 3,914,892 | A | 10/1975 | Mohr | |
| 4,105,127 | A | 8/1978 | Holl | |
| 4,440,371 | A | 4/1984 | Wijsman | |
| 4,563,796 | A | 1/1986 | Kettlestrings | |
| 4,629,075 | A | 12/1986 | Hutten | |
| 4,773,545 | A | 9/1988 | Jones | |
| 4,899,974 | A | 2/1990 | Wear et al. | |
| 4,996,785 | A | 3/1991 | Cicenas | |
| 5,500,987 | A | 3/1996 | Rosen | |
| 5,625,969 | A | 5/1997 | Vogler | |
| 5,718,402 | A | 2/1998 | Hoffman et al. | |
| 5,927,671 | A | 7/1999 | Pynenburg | |
| 6,018,850 | A * | 2/2000 | Lorber | 24/67.9 |
| D424,120 | S | 5/2000 | Wear | |
| 6,257,422 | B1 | 7/2001 | Rios | |
| 6,286,800 | B1 | 9/2001 | Junius et al. | |
| 6,467,742 | B1 | 10/2002 | Pitcher | |
| 6,678,977 | B1 | 1/2004 | Sherman | |
| 6,725,508 | B1 * | 4/2004 | Shirakawa et al. | 24/545 |

* cited by examiner

*Primary Examiner*—Lesley Morris
*Assistant Examiner*—Kristina Staley
(74) *Attorney, Agent, or Firm*—Galgano & Associates, PLLC

(57) ABSTRACT

A holder for clamping flexible sheet material includes an extruded plastic, elongated channel member having a base wall having two ends. The base wall is connected at one of the ends to a relatively short, upstanding forward leg having an inner face forming a bearing surface. The forward leg has a free upper end, and the base wall is connected at the other of the ends thereof to a relatively long, upstanding rearward leg having an upper end, and a top wall is joined to the upper end of the rearward leg. The top wall extends down behind the forward leg and has a free end which resiliently engages the bearing surface of the forward leg and it also has a crease or bend line spaced apart from the upper edge of the forward leg so as to define a wedge-shaped opening therebetween.

17 Claims, 4 Drawing Sheets

NOTE HOLDER

CROSS-REFERENCE TO RELATED APPLICATIONS

This application is a continuation in part of application Ser. No. PCT/US06/45262, filed Nov. 22, 2006 which is a continuation in part of U.S. application Ser. No. 11/285,971 filed Nov. 23, 2005 now abandoned, the complete disclosures of which are hereby incorporated herein by reference.

BACKGROUND OF THE INVENTION

1. Field of the Invention

This invention relates broadly to holders for removably holding sheet material such as a paper document. More particularly, this invention relates to an extruded plastic note holder which can be mounted on a surface such as the side of a computer monitor.

2. State of the Art

U.S. Pat. No. 2,530,821, issued to Hubbell in 1950, discloses a "Bulletin Sheet Holder and Support". The holder/support consists of a generally U-shaped rigid member and a semi-rigid (rubber) "blade" which extends from one wall of the U-shaped member to the other wall. A piece of paper is inserted between the free end of the blade and the adjacent wall of the rigid member.

U.S. Pat. No. 4,105,127, issued to Höll in 1978, discloses a "Holder Bar for Sheet-like Articles". The holder consists of a rectangular tube with a slot in one side wall. An inner omega-shaped clamp is disposed inside the tube with the open end of the clamp adjacent to the slot in the tube, A piece of paper inserted through the slot is engaged by the clamp, Both of the above-described patents require the manual assembly of multiple components. U.S. Pat. No. 4,629,075, issued to Hutten in 1986, discloses a "Mounting Strip". It consists of an elongated U-shaped, rigid plastic channel having a forward leg forming a bearing surface and a rearward leg forming a mounting surface. An elongated flexible gripper tongue is formed along the mounting surface of the channel and includes a clamping surface adapted to engage the bearing surface of the forward leg of the channel for receiving and clamping an article such as sheet material there between. The rigid plastic channel and flexible plastic gripper tongue are preferably co-extruded in a single operation to form a one-piece mounting strip having cooperating clamping elements with different durometer hardness. Hutten's mounting strip is more economical to manufacture compared to prior clamping devices described above because the channel and gripper tongue, having dual-durometer hardness, are integrally formed as a single co-extrusion. This eliminates the separate manufacturing operations required to fabricate the housing and clamping elements of prior art devices, as well as the additional step needed in such prior art devices to assemble the housing and clamping element.

While the Hutten device is clearly an improvement over the other two devices described above, it does have some disadvantages. The co-extrusion requires the use of two machines running at the same time extruding two different materials. Additionally, a rubber co-extrusion cannot exert much outward force on the bearing surface of the forward leg.

U.S. Pat. No. 4,563,796, issued to Kettlestrings in 1986, discloses a retainer for sheet material which is formed of resilient memory type material and which has two oppositely acting and opposed legs which provide a gripping action therebetween. Provision is made for one of the legs to act as an indicia carrying surface and a back surface of the retainer can be adapted to be adhesively mounted on a flat surface. Kettlestrings (in the claims) requires an inwardly biased front leg in order to provide gripping force against the rear leg and undesirably requires subsequent manipulation of the legs after molding to position them in a proper gripping position. However, those skilled in the art, upon consideration of FIG. 3 of Kettlestrings, will appreciate that when the extrusion is properly folded, it will assume the configuration shown in FIG. 3 wherein no opening space is provided between biased and abutting gripping points 32*a* and 42*a* and, for this and other reasons, Kettlestrings cannot effectively grip thin paper such as newspaper.

SUMMARY OF THE INVENTION

It is therefore an object of the invention to provide a holder for clamping flexible sheet materials and the like.

It is another object of the invention to provide a holder for clamping flexible sheet materials and the like which is inexpensive to manufacture.

It is a further object of the invention to provide a holder for clamping flexible sheet materials and the like which is easy to manufacture.

It is also an object of the invention to provide a holder for clamping flexible sheet materials and the like which is made from a single component.

It is an additional object of the invention to provide a holder for clamping flexible sheet materials and the like which is made from a single component having a uniform single durometer.

It is still another object of the invention to provide a holder for clamping flexible sheet materials and the like which can be mounted to a surface in different ways.

It is yet another object of the invention to provide a holder for clamping flexible sheet materials and the like which can accommodate both thick and thin materials side by side.

A holder for clamping a flexible sheet material and the like, comprising an extruded plastic, elongated channel member produced in a single extrusion of a single plastic material having a uniform durometer throughout, and having a base wall having two ends, said base wall being connected at one of said ends to a relatively short, upstanding forward leg having an inner face forming a bearing surface, said forward leg having a free upper end, and said base wall being connected at the other of said ends thereof to a relatively long, upstanding rearward leg having an upper end, and a top wall (tongue) having two ends, one of which is joined to said upper end of said rearward leg and the other of which defines a free end. The top wall is arranged to extend down from the top of said rearward leg to a position lying inside said forward leg so that its free end biases and resiliently engages the bearing surface of said inner face of said forward leg. The tongue is provided with a crease or bend line defining an interior obtuse angle at or very close to the top of the forward leg. As a result of the foregoing construction and the single extrusion of a single material to effectively form this holder in situ, i.e., without requiring any further manipulation of the legs after manufacture to orient them in their proper gripping position, it is believed that an improved gripping action is achieved with a resultant greater force being exerted by the resilient tongue free end toward the forward leg. The crease in the tongue provides a wedge-like or triangular-shaped opening which automatically adjusts for papers of different thickness.

Preferably, a double sided adhesive tape is attached on one side to one of said base wall and said rearward leg, and a release strip is detachably coupled to the other side of said double-sided adhesive tape. Alternatively, a mounting clip is joined to said rearward leg.

Desirably, the holder also includes a pair of end caps having at least one stanchion extending normally therefrom and said rearward leg has an interior track detachably engageable by said stanchion. The end caps make the holder aesthetically more appealing. In one embodiment, said forward and rearward legs are non-orthogonal relative to said base wall.

In another embodiment, an additional leg is formed behind the forward leg and extends upward and backward. It does not extend as far as the bottom end of the tongue. The additional leg prevents paper from curling when inserted between the forward leg and the tongue.

In still another embodiment, an additional leg is formed behind the forward leg so that it biases and resiliently engages the bearing surface of said inner face of said forward leg at a location below the location where the tongue engages the forward leg. The additional leg, due to its size, engages the forward leg less resiliently than the tongue does. This arrangement allows both thick and thin sheet materials to be clamped side by side. The thick materials are clamped between the tongue and the forward leg and thin materials are clamped between the additional leg and the forward leg.

In yet another embodiment, a track is provided on the interior of the tongue and the holder is made of clear plastic. The interior track on the tongue is then used to hold a paper strip bearing printed matter such as advertising.

Additional objects and advantages of the invention will become apparent to those skilled in the art upon reference to the detailed description taken in conjunction with the provided figures.

DETAILED DESCRIPTION OF THE PREFERRED AND ILLUSTRATED EMBODIMENTS

Figure 1:
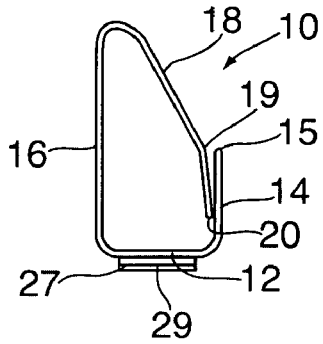
FIG. 1 is a side elevational view of the end of a first embodiment of a holder according to the invention as it is configured with the top wall (tongue) in its operational position arranged between the upstanding legs of the base wall and biasely engaging the shorter upstanding leg and with an adhesive mounting pad attached to its base.

Turning now to FIG. 1, therein illustrated is a one-piece, resilient plastic note holder 10 embodying the present invention for clamping flexible sheet material such as note paper and the like. Note holder 10 has a generally horizontally extending base wall 12 connected at one end to a relatively short upstanding forward leg 14 having a free end 15 and at its opposite end to a relatively tall or long, upstanding rear leg 16, which together define a generally U-shaped channel therebetween. A sloping top wall 18 which serves as a resilient gripper tongue is joined at one end to the rear leg and extends downwardly from the upper end of the rear leg 16 to a point behind the forward leg 14 and below the free upper end 15 of the forward leg 14. The tongue 18 is formed with a crease or bend line 19 which defines an interior obtuse angle. The crease 19 is vertically located approximately at the same location as the free upper end 15 of the forward leg 14 and horizontally spaced apart from the upper end 15. According to the presently preferred embodiment, the overall size of the note holder 10 is as follows: the rear leg 16 is approximately one inch tall and the forward leg 14 is approximately one half inch tall. The crease 19 is ideally vertically at the same location as the free upper end 15 of the forward leg 14, but may vary by ±0.06 inch. Horizontally, the opening or space between the crease 19 and the free upper end 15 is in the range of approximately 0.015 to 0.060 inches and is preferably approximately 0.02 inches. The bottom edge 20 of the tongue 18 is preferably approximately 0.36 inch ±0.015 from the crease 19. The overall length of the note holder (i.e., the dimension perpendicular to FIG. 1) is variable depending where the note holder will be used.

According to the invention, the one-piece holder 10 is formed from a single extrusion of a single durometer, semi-rigid plastic material such as polyvinylchloride or polypropylene and is cut to a desired length. The resilient tongue 18 is provided with a spring force or pretension which biasely urges it against the bearing or inner surface of leg 14. This technique eliminates the need for a more difficult and expensive co-extrusion.

The portion of the tongue 18 between the crease 19 and the lower end 20 forms a clamping surface with the forward leg 14. The wedge-shaped or triangular space between the crease 19 and the upper end 14 of the forward leg 14 allows the "clamp" to self-adjust to papers of different thickness.

Figure 4:
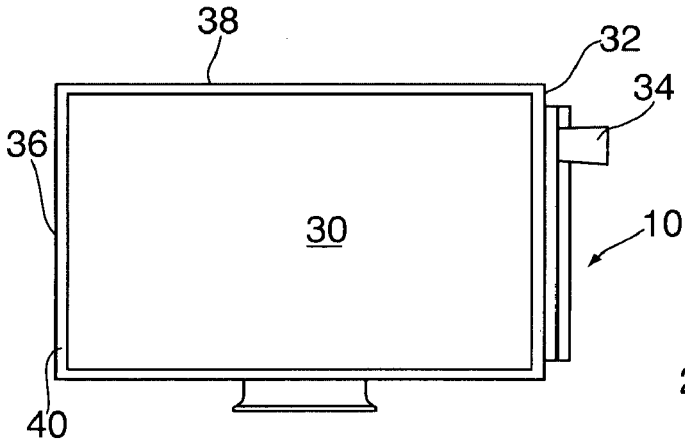
FIG. 4 is a front view of a computer monitor with a holder according to the invention attached to it and holding a piece of note paper.

As seen in FIG. 1, a double-sided adhesive tape 27 is attached on one side to the base wall 12 of the holder 10 and its other side is covered with a removable release strip 29. As seen in FIG. 4, this allows the holder to be conveniently attached to a computer monitor 30 where the holder 10 is attached to the right side 32 thereof, and which is shown holding a note 34. It will be appreciated that the holder 10 could just as easily be attached, e.g., to the left, top or front sides 36, 38, 40, respectively, of monitor 30 or attached to some other object as desired.

Figure 2:
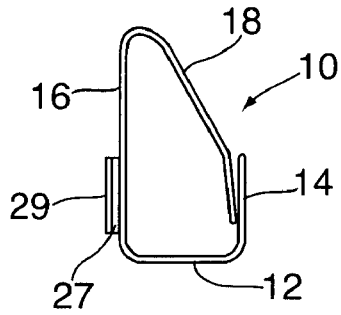
FIG. 2 is a view similar to FIG. 1 but showing an alternative position of the adhesive mounting pad.

FIG. 2 shows the double-sided adhesive tape 27 and release strip 29 in an alternate placement on the rear leg 16 rather than the base wall 12.

Figure 3:
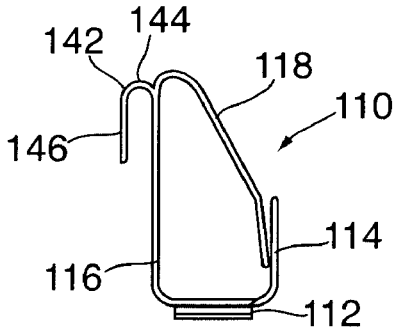
FIG. 3 is a view similar to FIG. 1 but of an embodiment having a hook extending substantially parallel to the rear wall.

Referring now to FIG. 3, a second embodiment 110 is similar to the first embodiment 10 shown in FIGS. 1 and 2 with similar reference numerals (increased by 100) referring to similar parts. In this embodiment, a generally L-shaped clip 142 is provided having a short leg 144 extending outwardly from the top end of rear leg 116 and a long leg 146 extending downwardly therefrom and substantially parallel to the rearward leg 116. Clip 142 can be used in conjunction with a J-shaped hanger (not shown) for mounting the holder on computer 30 or other item.

Figure 5:
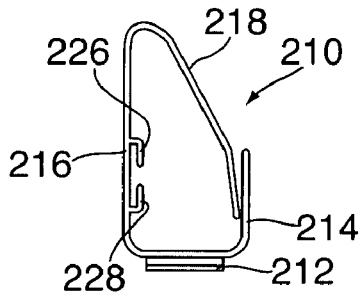
FIG. 5 is a view similar to FIG. 1, showing an embodiment with an inner track on the rear wall.
Figure 6:
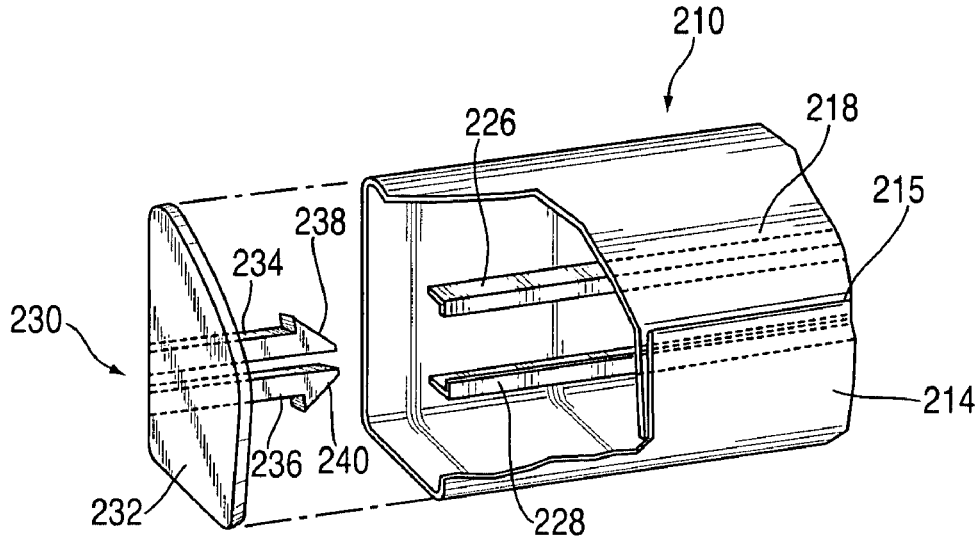
FIG. 6 is a broken perspective view of an end cap with the embodiment of FIG. 5.
Figure 7:
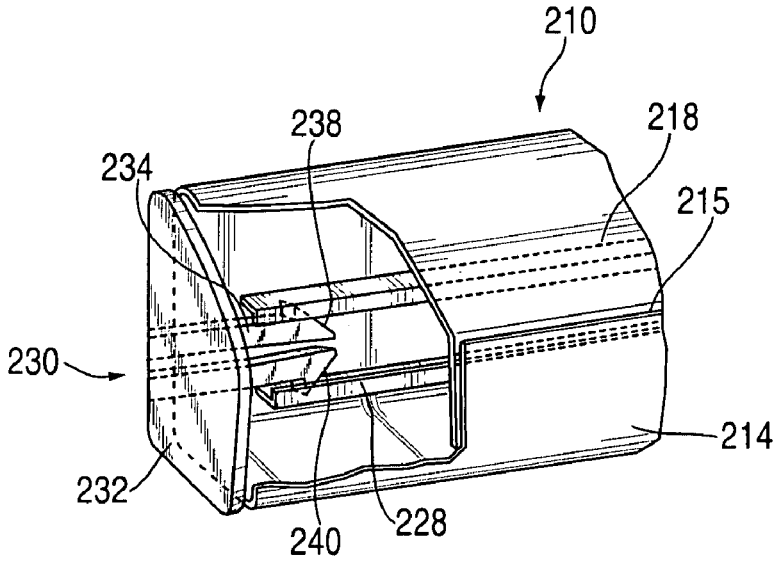
FIG. 7 is a broken perspective view illustrating the installation of the end cap.

Turning now to FIG. 5, the third embodiment is illustrated. The third embodiment 210 is similar to the first embodiment 10 with similar reference numerals (increased by 200) referring to similar parts. In this embodiment, the holder 210 is provided with an interior track on the inner surface of the rearward leg 216. The track is composed to two spaced-apart, L-shaped members 226, 228 These L-shaped members are easily extruded along the entire length of the extruded piece 210. These L-shaped members 226, 228 are used to secure end caps 230 to the holder 210 as illustrated in FIGS. 6 and 7. End caps 230 each have planar portion 232 which is shaped to have the same profile as the holder 210. A pair of resilient stanchions 234, 236 extend orthogonally from the planar portion 332. As seen in FIGS. 6 and 7, these stanchions 234, 236 each have a wedge-shaped barb 238, 240, respectively, at their end which engages one of the L-shaped track members 226, 228. The barbs 238, 240 are inserted into the channel defined by the track members 226, 228, and frictionally and biasedly engage the track members 226, 228, thereby restraining or inhibiting the removal of the end cap 230. When so inserted, the barbed ends 238, 240 of the two stanchions 234, 236 are wedged together to provide a friction fit within the channel defined by the L-shaped track members 234, 236; the introduction of the stanchions 234, 236 into the channel is aided by the sloped side of the wedge shaped barbs 238, 240 which cam the barbed ends 238, 240 of the stanchions together as they are inserted into the channel. Those skilled in the art will appreciate that a second end cap (not shown) which is a mirror image of the end cap 230 shown is provided to cap the other end of the holder 210.

Figure 8:
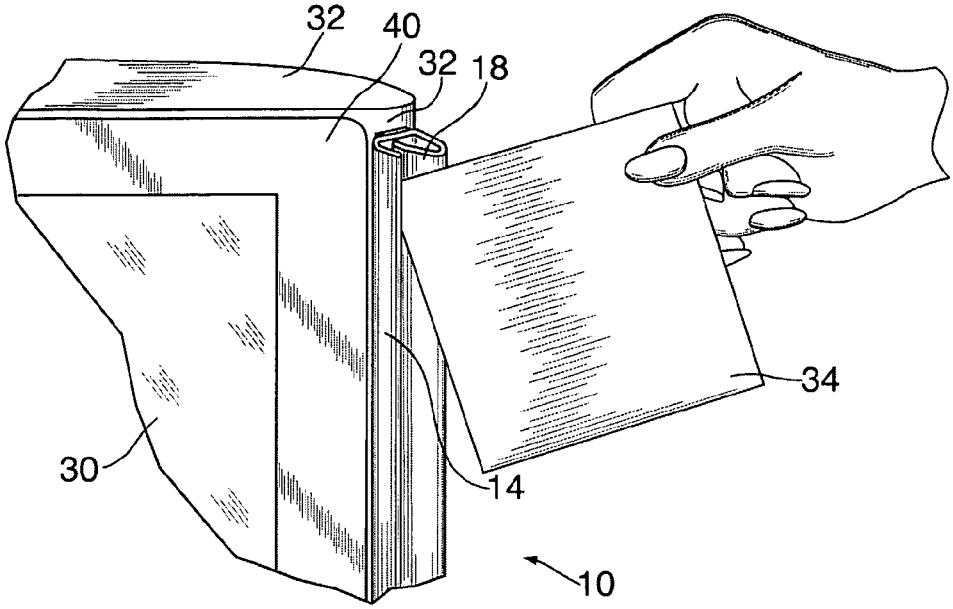
FIG. 8 is a broken perspective view illustrating how a piece of paper is inserted into the holder attached to the side of a computer monitor.

FIG. 8 shows the note holder 10 attached to the right side 32 of a computer monitor 30 with a sheet of paper 34 being easily inserted between the forward leg 14 and the tongue 18.

Figure 9:
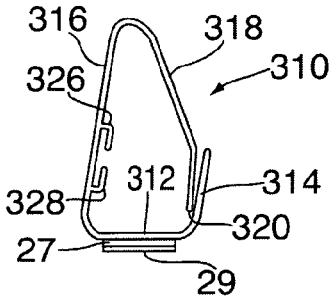
FIG. 9 is a view similar to FIG. 5 showing a forward leaning embodiment.

A further embodiment is illustrated in FIG. 9 which is comparable to FIG. 5 with similar reference numerals (increased by 100) referring to similar parts. Here, it can be seen that legs 314 and 316 are not orthogonal to the base 312. Rather, they are pitched forward (to the right in the drawing by about ten degrees. This makes it somewhat easier to insert a paper (not shown). It should also be noted that the tongue 318 is preferably dimensioned such that its end 320 does not touch the base 312.

For a preferred application, the holder is approximately one inch by one half inch in overall dimensions. The thickness of the plastic is preferably from 0.030 to 0.035 inch and is preferably polyvinylchloride or a material with a similar durometer. The space between the track members 226, 228 (326, 328) is preferably about one third of an inch. The double sided tape 27 is approximately three tenths of an inch thick. Of course, the various dimensions can be modified to suit a particular application.

Figure 10:
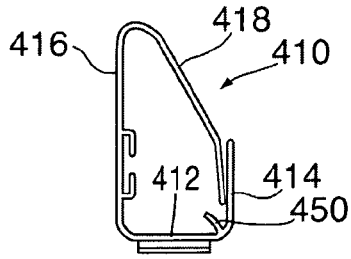
FIG. 10 is a view similar to FIG. 5 showing an embodiment with a stop to prevent paper curling.

Turning now to FIG. 10, the fifth embodiment is illustrated. The fifth embodiment 410 is similar to the first embodiment 10 with similar reference numerals (increased by 400) referring to similar parts. In this embodiment, there is an additional leg 450 which extends upward and rearward from the base wall 412 and is curved slightly away from the inner surface of the forward leg 414. The leg 450 prevents the edge of inserted paper from curling around the corner between the base 412 and the forward leg 414.

Figure 11:
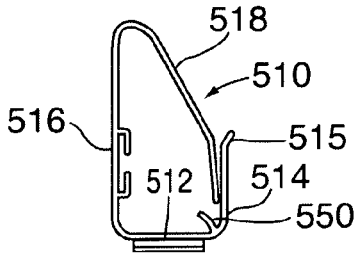
FIG. 11 is a view similar to FIG. 10 showing an embodiment where the upper end of the front leg is bent away from the tongue.

FIG. 11 shows a sixth embodiment 510 which is similar to the fifth embodiment with similar reference numerals (increased by 100) referring to similar parts. In this embodiment, the upper free end 515 of the forward leg 514 is bent slightly outward and away from the tongue 518. This facilitates entry of thicker paper.

Figure 12:
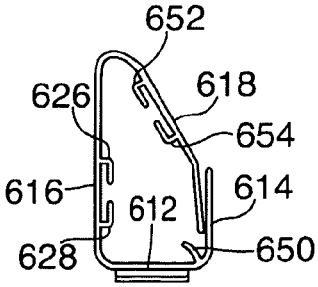
FIG. 12 is a view similar to FIG. 10 showing an inner track on the tongue.

FIG. 12 shows a seventh embodiment 610 which is similar to the fifth embodiment with similar reference numerals (increased by 100) referring to similar parts. In this embodiment, the holder 610 is made of clear plastic and the tongue 618 is provided with an interior track composed of spaced apart L-shaped members 652, 654. These members are similar to the members 626, 628 on the interior of the rearward leg 616. The purpose of the members 652, 654 is to hold an imprinted sheet material such as an advertisement or a trademark. If desired, the lower member 654 may be omitted and the sheet material may be held between the upper member 652 and the leg 650.

Figure 13:
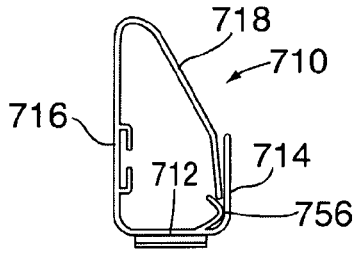
FIG. 13 is a view similar to FIG. 5 showing an embodiment with an inner leg biased against the interior of the front leg.
Figure 14:
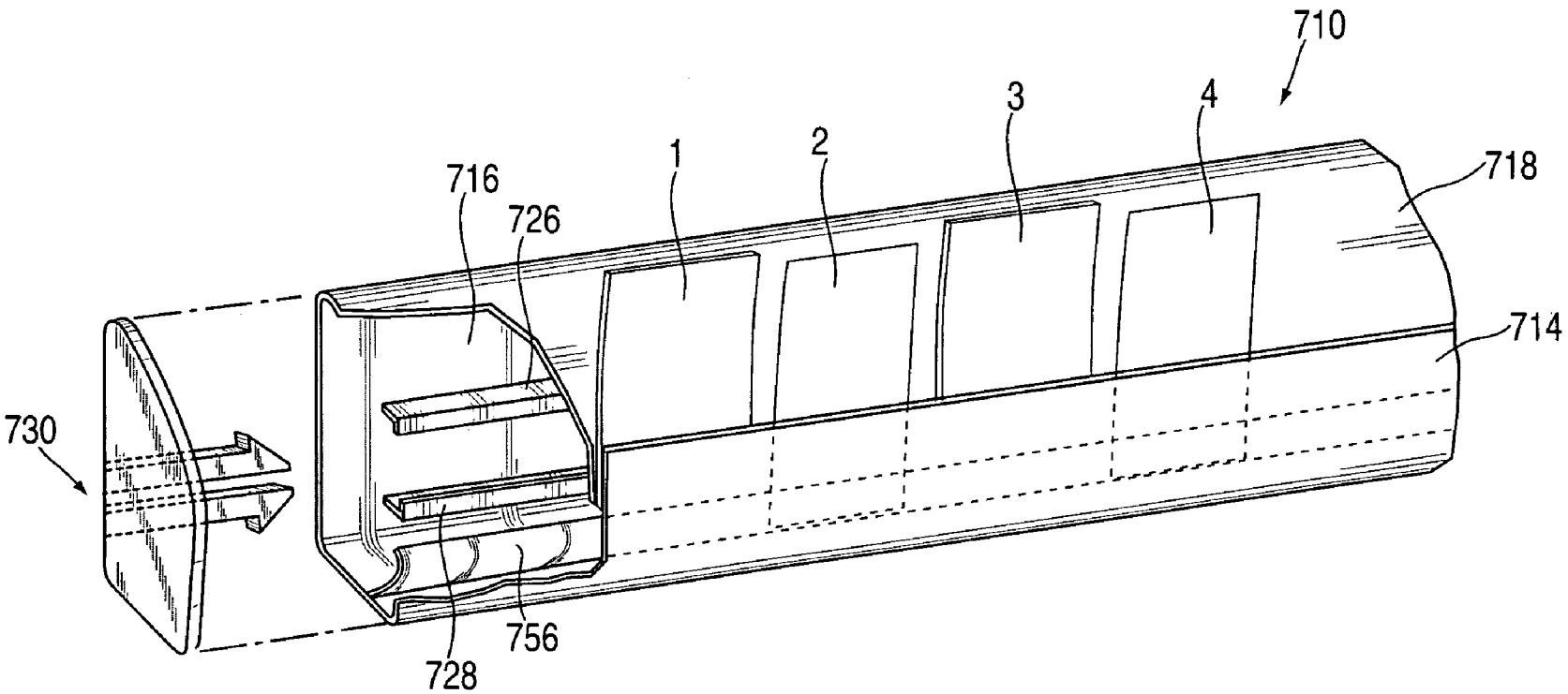
FIG. 14 is a view comparable to FIG. 13, but showing how the embodiment can hold thick and thin sheets side by side.

FIG. 13 shows an eighth embodiment 710 which is similar to the third embodiment with similar reference numerals (increased by 500) referring to similar parts. In this embodiment, there is an additional leg 756 which extends upward from the base wall 712 and is curved convexly toward the inner surface of the forward leg 714 which cooperates therewith to resiliently and frictionally grip a length of a sheet of paper therebetween. It will be noticed from FIG. 14 that alternating thick 1, 3 and thin 2, 4 sheets of paper can be held side by side. This is because the additional extruded leg 756 holds the thin sheets between it and the forward leg 714 whereas the tongue 718 holds the thicker sheets between it and the forward leg 714. The eighth embodiment can be made using the same type of extrusion process as the other embodiments.

There have been described and illustrated herein several embodiments of a note holder. While particular embodiments of the invention have been described, it is not intended that the invention be limited thereto, as it is intended that the invention be as broad in scope as the art will allow and that the specification be read likewise. For example, the durometer rating, type of plastic and/or the relative dimensions of the legs and walls of the note holder can be modified to adjust the resiliency of the holder and, in turn, the force by which it frictionally holds a note or the like. It will therefore be appreciated by those skilled in the art that yet other modifications could be made to the provided invention without deviating from its spirit and scope as claimed.

What is claimed is:

1. A one-piece holder for clamping a flexible sheet material, comprising:

an extruded plastic, elongated channel member produced in a single extrusion of a single plastic material having a uniform durometer throughout, comprising a generally rectilinear base wall, a forward leg, a rearward leg, and a top wall each having two opposite ends, formed in situ;

wherein said rearward leg and said forward leg also are generally rectilinear and are disposed generally perpendicular to said base wall with one of said ends of said rearward leg being connected to one of said ends of said base wall and one of said ends of said forward leg being connected to the opposite one of said ends of said base wall, and said other end of said forward leg defining a free end, wherein said forward leg is short relative to said rearward leg and has an inner face forming a bearing surface, and wherein one of said ends of said top wall is connected to the other of said ends of said rearward leg and the other of said ends of said top wall defines a free end, and wherein said top wall slopes downwardly from said rearward leg towards said front leg and extends down from said rearward leg to a position lying inside said forward leg and below said free end of said forward leg so that it is urged towards the inner face of the forward leg, so that its free end biasedly and resiliently engages the bearing surface of said inner face of said forward leg, thereby eliminating the necessity of further manipulation of the legs after extrusion to orient them in their proper gripping position.

2. The holder according to claim 1, further comprising:

a double sided adhesive tape attached on one side to one of said base wall and said rearward leg; and a release strip detachably coupled to another side of said double-sided adhesive tape.

3. The holder according to claim 1, further comprising:

a mounting clip joined to said rearward leg.

4. The holder according to claim 1, additionally comprising:

a pair of end caps having at least one stanchion extending normally therefrom and wherein said rearward leg has an interior track detachably engageable by said stanchion.

5. The holder according to claim 1, wherein:

said forward and rearward legs are non-orthogonal relative to said base wall.

6. The holder according to claim 1, further comprising:

an inner leg adjacent said forward leg and said base.

7. The holder according to claim 6, wherein:

said inner leg extends toward said rearward leg.

8. The holder according to claim 7, wherein:

said top wall further includes an interior L-shaped member.

9. The holder according to claim 6, wherein:

said inner leg extends toward said forward leg.

10. The holder according to claim 9, wherein:

said inner leg is curved.

11. The holder according to claim 10, wherein:

said inner leg is convex facing said forward leg.

12. The holder according to claim 1, wherein:

said top wall includes interior means for holding a strip of printed matter.

13. The holder according to claim 12, wherein:

said interior means includes a pair of L-shaped members.

14. The holder according to claim 1, wherein:

said forward and rearward legs are substantially orthogonal relative to said base wall.

15. The holder according to claim 1, wherein:

said top wall has a crease spaced from said free end thereof which defines an interior obtuse angle which is located substantially adjacent said free upper end of said forward leg to define therebetween a wedge-shaped opening.

16. The holder according to claim 15, wherein:

said forward leg is provided with a bent segment generally adjacent its free end which is positioned substantially adjacent said crease.

17. The holder according to claim 1, wherein:

said ends of said top wall, rearward leg, forward leg and base wall by which they are connected together are rounded.

* * * * *